United States Patent [19]

Marmillion

[11] Patent Number: 4,636,020

[45] Date of Patent: Jan. 13, 1987

[54] INSERT FOR AN ELECTRICAL CONNECTOR

[75] Inventor: David J. Marmillion, Afton, N.Y.

[73] Assignee: Allied Corporation, Morristown, N.J.

[21] Appl. No.: 499,707

[22] Filed: May 31, 1983

[51] Int. Cl.[4] ..... H01R 11/00

[52] U.S. Cl. ..... 339/59 M; 339/217 S; 339/218 S

[58] Field of Search ..... 339/59 R, 59 M, 61 R, 339/61 M, 217 S, 218 S

[56] References Cited

U.S. PATENT DOCUMENTS

| | | | |
|---|---|---|---|
| 3,165,369 | 1/1965 | Maston | 339/59 |
| 3,697,935 | 10/1972 | Drapkin | 339/217 S |
| 3,914,003 | 10/1975 | Loy | 339/218 S |
| 3,938,874 | 2/1976 | Bourdon | 339/59 M |
| 4,082,398 | 4/1978 | Bourdon et al. | 339/59 M |
| 4,221,446 | 9/1980 | Niles et al. | 339/217 S |
| 4,358,179 | 11/1982 | Bourdon et al. | 339/217 S |
| 4,374,604 | 2/1983 | Hemmer et al. | 339/59 R |
| 4,498,718 | 2/1985 | Duncan | 339/59 M |

*Primary Examiner*—Gil Weidenfeld
*Assistant Examiner*—Paula A. Austin
*Attorney, Agent, or Firm*—R. J. Eifler; C. D. Lacina

[57] ABSTRACT

This invention relates to electrical connectors of the type having insertable contacts. The invention is more particularly related to the molded contact retaining insert (10) of the connector that is characterized by a plurality of triangularly shaped passages (15) each having a retention finger (1, 2, 3) in each corner of the triangle to maximize the density of the passages (15) within a given area. At least one side (11) of each passage (15) is parallel to one side (13) of an adjacent passage.

8 Claims, 2 Drawing Figures

INSERT FOR AN ELECTRICAL CONNECTOR

This invention relates to an electrical connector and more specifically to a dielectric insert within the connector that retains electrical contacts.

Electrical connectors generally include a plug and receptacle each having an insert of dielectric material provided with axial passages within which electrical contacts are retained. Some contacts inserts allow removal and insertion of the contacts from either the front or the rear of the insert. Examples of prior electrical connectors having insertable and removable contacts may be found in U.S. Pat. Nos. 3,165,369 entitled "Retention System For Electrical Contacts" issued Jan. 12, 1966 and 4,082,398 entitled "Electrical Connector With Front and Rear Insertable and Removable Contacts" issued Apr. 4, 1978.

The connector insert as shown in the 4,082,398 patent is typical of all prior art inserts wherein there are axially extending circular passageways having diameters large enough to permit contact retaining fingers in each passage to be deflected outwardly for insertion or removal of a contact. Because of the clearance required for operation of the contact retaining fingers within each passage and the need for dielectric material between passages only so many passages may be located within a particular size insert. For instance the area taken up by 120 circular passages can contain about 150 triangular passages.

DESCRIPTION OF THE INVENTION

This invention is an electrical connector insert that provides a new arrangement for retaining contacts in a connector insert. The insert is also capable of retaining more contacts per a given size insert than was previously possible. The invention is an insert characterized by triangularly shaped axial passages that are arranged adjacent to each other. Each of the triangularly shaped passages are characterized by a deflectable contact retaining finger located in each corner of the triangle. The free ends of the deflectable fingers are adapted to engage the shoulder on an electrical contact.

Accordingly, it is an advantage of this invention to provide an electrical connector insert that will retain more electrical contacts then the same size insert having circular passages.

It is another advantage of this invention to provide a new arrangement for retaining electrical contcts in an electrical connector insert.

Figure 1:
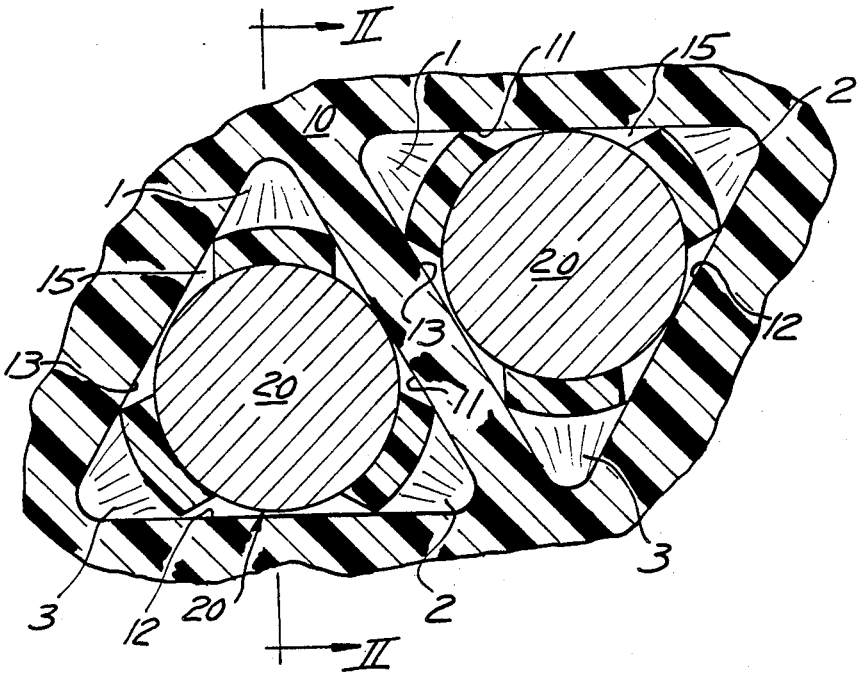
FIG. 1 is a cross sectional view of an electrical connector insert incorporating the principles of this invention.

Referring now to the drawings, FIG. 1 illustrates an insert 10 having triangularly shaped axial passages 15. Each of the passages 15 include a resiliently deflectable finger 1, 2, 3 in each corner of the triangular passage 15. Each of the fingers 1, 2, 3 extend radially inward and terminate in a free end that is adapted to engage a shoulder on a contact 20. Each triangular passage 15 includes three walls 11, 12, 13 with at least one wall 11 parallel to a wall 13 of an adjacent passage 15. The ends of each finger 1 may be shaped to include a forwardly facing shoulder below an inwardly tapered portion to permit a tool to deflect the fingers 1 outwardly to release the contact for removal.

Figure 2:
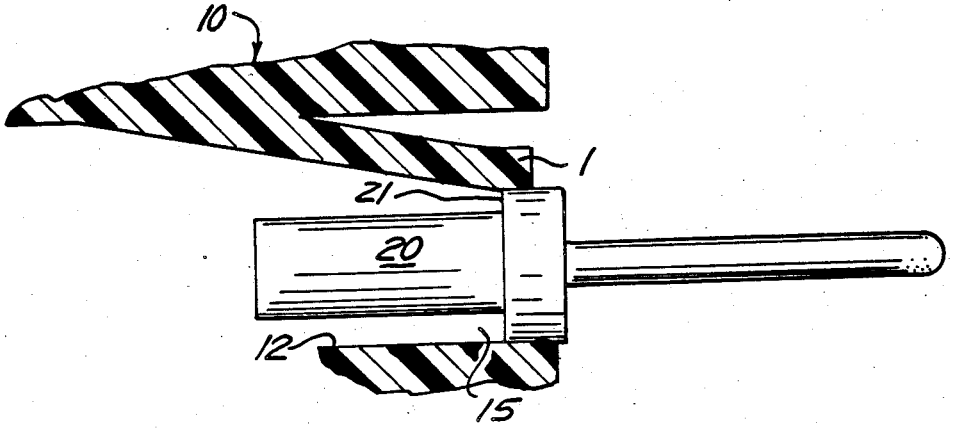
FIG. 2 is a partial cross sectional view in the axial direction of the insert shown in FIG. 1.

FIG. 2 illustrates the free end of a deflectable finger 1 disengaged from the shoulder 21 of the electrical contact 20.

Having described the invention, what was claimed is:

1. An insert for an electrical connector assembly, said insert comprising:

a body of dielectric material having a pair of end faces and at least one triangularly shaped axial passage extending between said end faces; and a resiliently deflectable finger located in each corner of said triangular passage, each finger disposed between the end faces and extending radially inward and terminating in a free end, the other end of each finger being integral with adjacent walls of said passage.

2. The insert as recited in claim 1 wherein the insert is a one piece body of molded dielectric material having a plurality of triangularly shaped passages.

3. The insert as claimed in claim 1 wherein there are a plurality of triangularly shaped axial passages each being arranged adjacent to each other and extending axially between the end faces with one side of each passage being parallel to one side of another passage.

4. The insert as recited in claim 3 wherein the insert is a one piece body of molded dielectric material having a plurality of triangularly shaped passages.

5. The insert as recited in claim 1 wherein the innermost wall of each deflectable finger in said passage is arcuately shaped to define a circular opening between the free ends of said fingers.

6. The insert as recited in claim 5 wherein the insert is a one piece body of molded dielectric material having a plurality of triangularly shaped passages.

7. The insert as recited in claim 5 wherein there are a plurality of triangularly shaped axially passages arranged adjacent to each other with one side of each passage parallel to one side of another passage.

8. The insert as recited in claim 7, wherein the insert is a one piece body of molded dielectric material having a plurality of triangularly shaped passages.

* * * * *